US009422911B2

(12) United States Patent
Kawashima

(10) Patent No.: US 9,422,911 B2
(45) Date of Patent: Aug. 23, 2016

(54) GASKET FOR ATTACHING SPARK PLUG AND IGNITION SYSTEM

(71) Applicant: DENSO CORPORATION, Kariya, Aichi-pref. (JP)

(72) Inventor: Yasushi Kawashima, Mie-ken (JP)

(73) Assignee: DENSO CORPORATION, Kariya (JP)

( * ) Notice: Subject to any disclaimer, the term of this patent is extended or adjusted under 35 U.S.C. 154(b) by 89 days.

(21) Appl. No.: 13/940,610

(22) Filed: Jul. 12, 2013

(65) Prior Publication Data

US 2014/0020646 A1 Jan. 23, 2014

(30) Foreign Application Priority Data

Jul. 18, 2012 (JP) ..... 2012-159612

(51) Int. Cl.
*F02P 15/00* (2006.01)
*H01T 13/08* (2006.01)

(52) U.S. Cl.
CPC ..... *F02P 15/00* (2013.01); *H01T 13/08* (2013.01); *Y10S 277/941* (2013.01)

(58) Field of Classification Search
CPC ..... F02P 15/00; H01T 13/08; H01T 13/12; F02F 1/242; Y10S 277/941
USPC ..... 123/169 A, 647, 169 R
See application file for complete search history.

(56) References Cited

U.S. PATENT DOCUMENTS 2,687,713 A * 8/1954 Newton ..... H01T 13/52 313/131 A
2,921,109 A * 1/1960 Novak ..... H01T 13/08 123/169 R
4,999,336 A * 3/1991 Nadkarni ..... B22F 1/0003 505/124
7,272,970 B2 * 9/2007 Ozeki ..... G01L 23/22 73/35.12
7,477,006 B2 * 1/2009 Fukuzawa ..... H01T 13/08 123/169 R
7,914,353 B2 * 3/2011 Kobayashi ..... H01T 13/08 313/118
2006/0284535 A1 * 12/2006 Ozeki ..... G01L 23/22 313/143
2008/0098974 A1 5/2008 Fukuzawa et al.
2014/0042894 A1 * 2/2014 Miyashita ..... H01T 13/08 313/144
2014/0145405 A1 * 5/2014 Suzuki ..... H01T 13/08 277/650

FOREIGN PATENT DOCUMENTS

JP EP 0459510 A2 * 12/1991 ..... F16L 23/20
JP 6-174097 6/1994
JP 11-351393 12/1999

(Continued)

OTHER PUBLICATIONS

Ellis, David L., and William S. Loewenthal. "Comparison of GRCop-84 to other Cu alloys with high thermal conductivities." Journal of materials engineering and performance 17.4 (2008): 594-606.*

(Continued)

*Primary Examiner* — Hung Q Nguyen
*Assistant Examiner* — Kevin R Steckbauer
(74) *Attorney, Agent, or Firm* — Nixon & Vanderhye P.C.

(57) ABSTRACT

A gasket for attaching a spark plug to an internal combustion engine, the gasket having an annular portion. The annular portion is annular to surround the spark plug, and has contact surfaces on both axial ends, one of the contact surfaces being to contact the spark plug, the other being to contact the internal combustion engine. The annular portion is composed of copper alloy containing aluminum oxide. The aluminum oxide content of the copper alloy is 0.3 wt % or more, and 0.7 wt % or less.

8 Claims, 4 Drawing Sheets

(56) References Cited

FOREIGN PATENT DOCUMENTS

| | | | |
|---|---|---|---|
| JP | 2000- 12187 | 1/2000 | |
| JP | 2008-135370 | 6/2008 | |
| JP | 4530418 | 6/2010 | |
| JP | WO 2012147503 A1 * | 11/2012 | ..... H01T 13/08 |

OTHER PUBLICATIONS

Office Action (2 pgs.) dated May 19, 2015 issued in corresponding Japanese Application No. 2012-159612 with an at least partial English-language translation (2 pgs.).

* cited by examiner

GASKET FOR ATTACHING SPARK PLUG AND IGNITION SYSTEM

CROSS-REFERENCE TO RELATED APPLICATION

This application is based on and claims the benefit of priority from earlier Japanese Patent Application No. 2012-159612 filed Jul. 18, 2012, the description of which is incorporated herein by reference.

BACKGROUND OF THE INVENTION

1. Technical Field of the Invention

The present invention relates to a gasket for attaching a spark plug to an internal combustion engine and an ignition system.

2. Related Art

Conventionally, it is known that a gasket is arranged between an internal combustion engine and a spark plug which ignites air-fuel mixture flowing into a combustion chamber of the internal combustion engine. The known gasket is annular to surround an axis of the spark plug, one of known types of the gasket has a flat plate-like structure, and another type has cross-section perpendicular to the circumferential direction which is substantially sigmoid.

Such a gasket intends to prevent the spark plug screwed to the internal combustion engine from loosening, and prevent combustion gas from leaking from the internal combustion engine outside.

On the other hand, recently, in the internal combustion engine, combustion under lean-burn condition where mixture of air and less fuel is introduced into the combustion chamber is applied with the aims of environmental conservation and high efficiency. In this case, a method for preventing fire from burning out when lean-burn is applied is suggested. In the method, locating a ground electrode and a discharge portion at the end of the spark plug on a position where the flow of the mixture is not interrupted allows the mixture to flow into the discharge portion of the spark plug stably.

In such a spark plug, therefore, the gasket has an important function in view of positioning the spark plug. For satisfying such a demand, for example, a gasket disclosed in patent document 1 (JP-A-H11-351393) aims for allowing the ground electrode of the spark plug to be positioned easily in a state where proper tightening force is applied. The gasket disclosed in the patent document 1 is made from porous metal. Then, a compressional deformation amount of the gasket to specified tightening torque of the spark plug is designed within a predetermined range so that the spark plug can be rotated within a comparatively large angle with contact pressure (described below) maintained in a target range. The angle of the ground electrode at the end of the spark plug, therefore, can be regulated by rotating the spark plug within the target contact pressure range.

SUMMARY

Here, trying to set the projection position of the ground electrode projected inside of the combustion chamber constant results in the projection position varying because of deformation in the gasket. The variability becomes greater when a sigmoid gasket is used. When a flat gasket is used, the deformation amount of the gasket to the tightening torque is smaller, so that the variability becomes smaller.

On the other hand, a larger tightening torque is needed to ensure correct sealing, because the tightening torque needed to produce the deformation of the flat gasket increases.

For solving the increase in tightening torque, the gasket composed of copper whose longitudinal elasticity modulus is small can be supposed. Using a gasket composed of copper between seating surfaces generally formed from iron and steel materials, furthermore, can increase adherence between the gasket and the seating surfaces and sealing properties. If the gasket composed of only copper is used, however, hardness of copper decreases at high temperature, which causes creep where the deformation amount increases under constant pressure or load with increasing time. Therefore, the gasket composed of only copper has a problem in durability; causing looseness due to long term use.

The present disclosure provides a gasket for attaching a spark plug and an ignition system having the spark plug which can ensure good sealing properties and durability even when accurate positioning of the ground electrode is demanded.

The present inventor have found that using copper alloy which includes aluminum oxide in the gasket can maintain the advantages of copper, i.e. high adhesion between the gasket and the spark plug and between the gasket and the internal combustion engine, and, can also prevent creep in copper due to softening under high temperature.

An exemplary embodiment provides a gasket for attaching a spark plug to an internal combustion engine, the gasket having an annular portion. The annular portion is annular to surround the spark plug, and has contact surfaces on both axial ends, one of the contact surfaces being to contact the spark plug, the other being to contact the internal combustion engine. The annular portion is composed of copper alloy containing aluminum oxide. The aluminum oxide content of the copper alloy is 0.3 wt % or more, and 0.7 wt % or less.

Another exemplary embodiment provides an ignition system having a spark plug, a wall member configured to form a combustion chamber of an internal combustion engine, and a gasket. The gasket is sandwiched between the wall member and the spark plug with axial load of the spark plug. The gasket has an annular portion which is annular to surround the spark plug. The annular portion has contact surfaces, one of the contact surfaces being to contact the spark plug, the other being to contact the internal combustion engine. The annular portion is composed of copper alloy containing aluminum oxide, and the aluminum oxide content of the copper alloy is 0.3 wt % or more, and 0.7 wt % or less.

Another exemplary embodiment provides a method for attaching a spark plug to an internal combustion engine. In the method, the gasket having an annular portion is disposed between the spark plug and the internal combustion engine. The annular portion is annular to surround the spark plug, and is composed of copper alloy containing aluminum oxide. The aluminum oxide content of the copper alloy is 0.3 wt % or more, and 0.7 wt % or less.

DETAILED DESCRIPTION OF THE PREFERRED EMBODIMENTS

First Embodiment

Hereinafter, a gasket and an ignition system having an internal combustion engine, a spark plug, and the gasket according to a first embodiment are described, referring FIG. 1 to FIG. 5.

Figure 1:
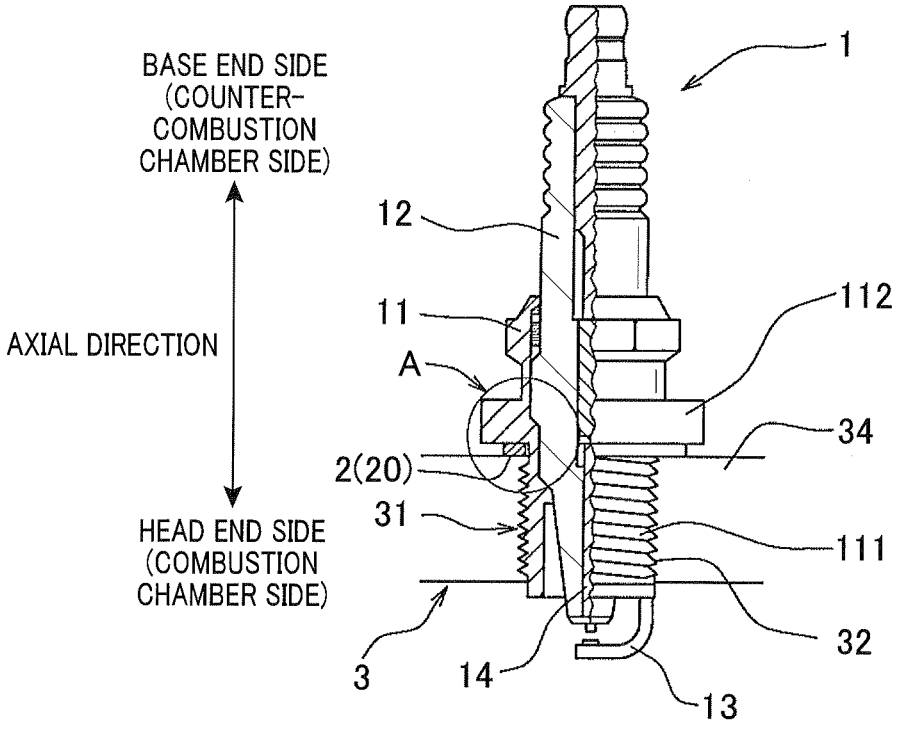
FIG. 1 is a partial-sectional view illustrating a spark plug and a gasket attached to an internal combustion engine according to a first embodiment.

FIG. 1 shows a partial-sectional view illustrating the spark plug 1 and the gasket 2 attached to the internal combustion engine 3 according to the first embodiment.

The spark plug 1 is tightened with specified tightening torque to be screwed through the gasket 2 to a wall member 34 forming a combustion chamber of the internal combustion engine 3.

The spark plug 1 has an attachment member 11, an insulator 12, a center electrode 14, and a ground electrode 13. The spark plug extends along an axis of the spark plug. The attachment member 11 is substantially cylindrical to surround the axis of the spark plug, and is composed of metal. The insulator 12 is substantially cylindrical, and held in an inner periphery surface of the attachment member 11. The center electrode 14 is substantially columnar and held in an inner periphery of the insulator 12. The ground electrode 13 projects inside the combustion chamber side (referred to a "head end side") to face the head end side of the center electrode. Here, one of the axial ends, which is on the combustion chamber side, is referred to a head end, and the other end which is on a counter-combustion chamber side opposite to the combustion chamber side in the axial direction of the spark plug 1 is referred to a base end.

The attachment member 11 is provided with a screw portion 111 and a plug large diameter portion 112. The screw portion 111 is formed to the counter-combustion chamber side (the base end side) of the ground electrode 13. The plug large diameter portion 112 has a larger outer diameter than that of the screw portion 111. The plug large diameter portion 112 is formed to the counter-combustion chamber side (the base end side) of the screw portion 111.

The wall member 34 of the internal combustion engine 3 is provided with an attachment hole 31, and an inner surface of the attachment hole 31 is provided with an attachment hole screw portion 32 having an internal thread and engaging with the spark plug 1. The spark plug 1 is fastened to the internal combustion engine 3 through thread engagement of the screw portion 111 formed on the attachment member 11 and the attachment hole screw portion 32.

Figure 2:
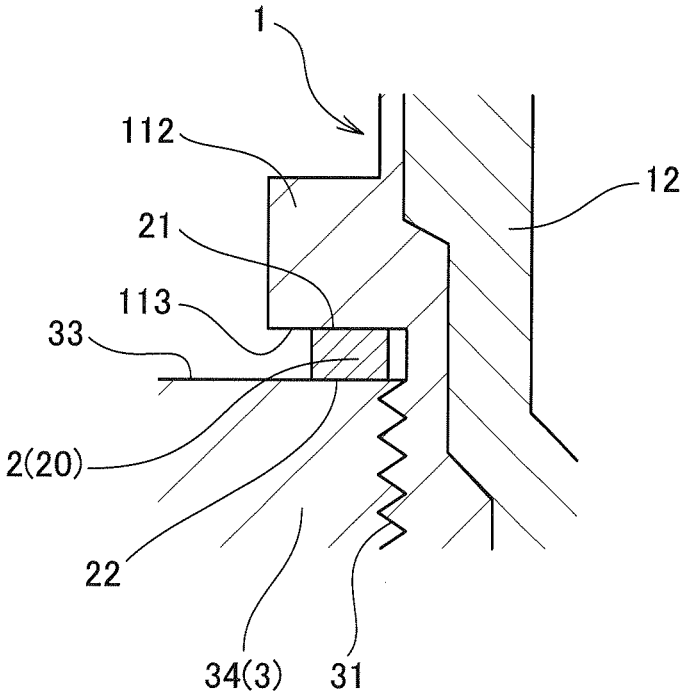
FIG. 2 is a cross-sectional view illustrating an enlarged main part which is marked with 'A' in FIG. 1.

FIG. 2 shows a cross-sectional view illustrating an enlarged main part of the gasket 2 located between the spark plug 1 and the internal combustion engine 3. Here, the "main part" refers to the marked area A in FIG. 1.

The surface on the counter-combustion chamber side of the wall member 34 of the internal combustion engine 3 is provided with an attachment seating surface 33. The attachment seating surface 33 is formed to surround the attachment hole 31, and perpendicular to the axial direction of the spark plug 1. The head end surface (the surface on the head end side) of the plug large diameter portion 112 is provided with a plug seating surface 113 formed to be substantially parallel to the attachment seating surface 33. The gasket 2 is sandwiched between the attachment seating surface 33 and the plug seating surface 113 to contact them.

The gasket 2 has an annular portion 20 which is annular and capable of surrounding the spark plug 1. The annular portion 20 is formed with sheet composed of copper alloy into an annular shape. The copper alloy contains aluminum oxide, aluminum oxide content of the copper alloy is 0.3 wt % (weight percent) or more, and 0.7 wt % or less. The spark plug 1 is inserted into the inner periphery of the annular gasket 2 to surround the outer periphery of the spark plug 1, and ends of the axial direction of the annular portion 20 are provided with a plug contact surface 21 and an engine contact surface 22 as seal surfaces in this embodiment. The plug contact surface 21 formed on a surface of the counter-combustion chamber side of the gasket 2 contacts the plug seating surface 113, when the gasket 2 is sandwiched between the spark plug 1 and the internal combustion engine 3. The engine contact surface 22 formed on a surface of the combustion chamber side of the gasket 2 contacts the attachment seating surface 33, when the gasket 2 is sandwiched between the spark plug 1 and the internal combustion engine 3.

Figure 3:
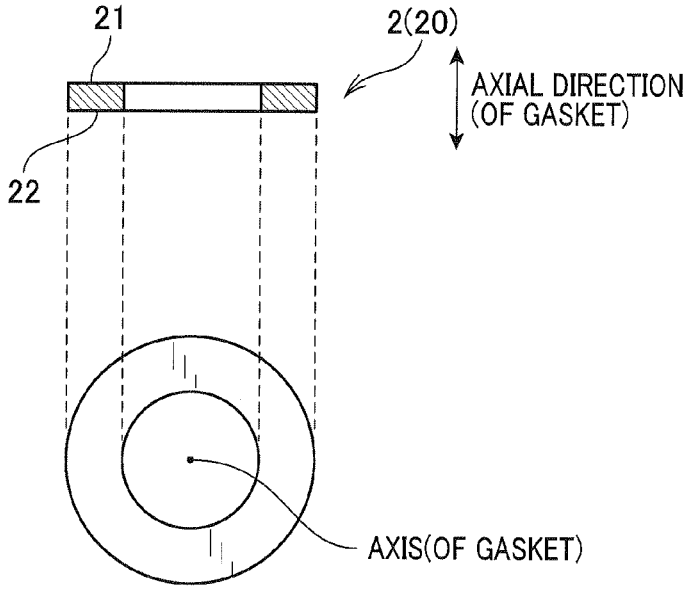
FIG. 3 is a cross-sectional view and a plan view of the gasket according to the first embodiment.

FIG. 3 shows a cross-sectional view and a plan view of the gasket 2 according to the first embodiment. As shown in FIG. 3, the gasket 2 is annular, has a flat plate-like structure, and its cross-section in a plane including the axis of the spark plug 1, i.e. a cross-section perpendicular to the circumferential direction of the gasket 2, is rectangular. The gasket 2 is subjected to the load in the axial direction of the spark plug 1 to be deformed, the load being generated by tightening the spark plug 1 with the specified tightening torque. The gasket 2 according to this embodiment, as shown in FIG. 2, keeps flat after the deformation due to the axial load.

The specified tightening torque can be set properly depending on the outer diameter and the inner diameter of the gasket 2 etc. so that the deformation amount at the time when the gasket 2 deforms in the axial direction of the spark plug 1 is suitable.

In this embodiment, the specified tightening torque is loaded so that the pressure value per unit area on the engine contact surface 22 and the attachment seating surface 33, and, the pressure value per unit area on the plug contact surface 21 and the plug seating surface 113, referred to "contact pressure" in this document, are 40 $N/mm^2$ or above.

Effects derived from the configurations according to this embodiment are described, hereinafter.

The gasket 2 is used within the elastic region of material composing the gasket 2. Metal material has an elastic region and a plastic region. In the elastic region, loaded stress generates strain in the material. After the stress has been removed, the strain in material recovers to the state before loading the stress. On the other hand, in the plastic region, even after the stress has been removed, the strain in the material remains, and irreversible deformation remains. In the elastic region, reaction force in the opposite direction to the direction of the loaded load is produced. The gasket 2 is subject to the axial force in the axial direction of the spark plug 1, and generates the reaction force due to the axial force from the gasket 2 to the plug seating surface 113 and the attachment seating surface 33, which loads the contact pressures on the plug seating surface 113 and the attachment surface 33.

The gasket 2, furthermore, is used for holding the axial force generated by the tightening torque of the spark plug 1. Generally, the attachment member 11 of the spark plug 1 is composed of iron and steel material etc., and the wall member 34 of the internal combustion engine 3, which has the attachment seating surface 33, is composed of iron and steel material etc. . . . . The plug seating surface 113 and the attachment seating surface 33 have minute concavities and convexities on their surface. If the plug seating surface 113 and the attachment seating surface 33 directly contact with each other, vibration of the internal combustion engine 3 slides the contact surfaces 33 and 113 on each other, which causes fretting wear on the surfaces 33 and 113. High hardness material such as iron and steel composing the attachment member 11 and the wall member 34 also advances the fretting wear.

This wear advances planarization on the contact surfaces, which decreases the frictional resistance of the contact surfaces. The axial force of the spark plug 1 is determined depending on the loaded torque when the spark plug 1 is tightened, frictional resistance on the surface which contacts the spark plug 1, and so on. If the frictional resistance is decreased because of increasing the planarization, the axial force acting on the spark plug 1 is reduced. The reduction of the axial force undermines the function for fastening the spark plug 1 to the internal combustion engine 3, which is liable to cause the thread engagement of the screw portion 111 and the attachment hole screw portion 32 to be loosened.

Compared to this case, providing between the plug seating surface 113 and the attachment seating surface 33 with the gasket 2 can act the reaction force from the gasket 2 on the plug seating surface 113 and the attachment seating surface 33, even if the planarization of the interfaces between the gasket 2 and the seating surfaces (the plug seating surface 113 and the attachment seating surface 33) have advanced. This can prevent decrease in frictional resistance due to the planarization. As a result, the reduction of the axial force is prevented, which can prevent the spark plug 1 from being loosened.

The gasket 2, furthermore, containing copper is more deformable at the interfaces between the gasket 2 and the seating surfaces (the plug seating surface 113 and the attachment seating surface 33). Therefore, the interfaces at the plug contact surface 21 and the engine contact surface 22 of the gasket 2 which receive the contact pressure loaded on the plug seating surface 113 and the attachment seating surface 33 deforms in accordance with concavities and convexities on the plug seating surface 113 and the attachment seating surface 33. This decreases the number of gaps between the plug seating surface 113 and the plug contact surface 21 and between the attachment seating surface 33 and the engine contact surface 22, so that the adhesion strength at interfaces increases. The decrease in the number of gaps closes the passages for gas in the combustion chamber of the internal combustion engine 3 to leak outside, which can ensure better sealing properties.

On the other hand, copper products have a drawback that the copper products decrease in hardness under high-temperature environments to cause creep. In the creep, the copper products which are under continuous pressure suffer increasing deformation. If the gasket 2 creeps, the respective reaction force acted on the plug seating surface 113 and the attachment seating surface 33 by the gasket 2 decreases, and the frictional resistance and the axial force decrease, which causes looseness. In addition, when the thread engagement of the attachment hole screw portion 32 and the attachment hole 31 is loosened because of decrease in the axial force of the spark plug 1, the looseness may be further advanced by the vibration of the internal combustion engine 3.

In this embodiment, the copper alloy containing 0.3 wt % to 0.7 wt % (include 0.3 wt % and 0.7 wt % in this document) is used. This gasket 2 in which copper alloy is used is resistant to decrease in hardness even under high temperature environments, and can prevent creep.

Figure 4:
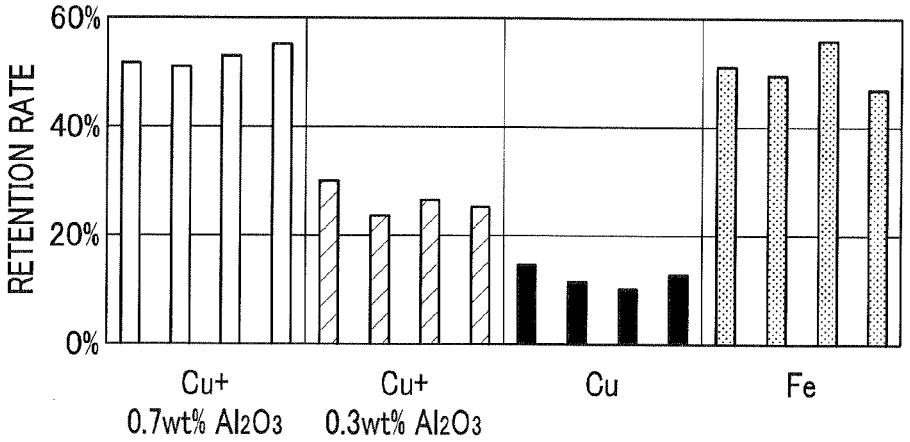
FIG. 4 is a chart illustrating results of an endurance test under high temperature environment for gaskets in the first embodiment.

The present inventers performed an endurance test for confirming the creep preventing effect of the gasket 2 according to this embodiment under high-temperature environment, and compared the results of this embodiment to those of others. FIG. 4 shows the results.

In this test, the gaskets 2 having the respective comparative composition were prepared. Then, the spark plug 1 was attached to an instrument emulating the internal combustion engine 3 through each gasket 2, and tightened to be fastened with a predetermined tightening torque. Then, the instrument with the respective gasket 2 and the spark plug 1 was left under an atmosphere at 300° C. for 200 hours, after that, cooled under an atmosphere at room temperature. Further, then, the spark plug 1 was detached from the instrument, and torque needed for detaching (referred to "loosening torque" below) was determined.

In each gasket 2, the increase in temperature decreases hardness temporary, and the axial force decreases. The loosening torque needed for detaching the spark plug 1 which is cooled under the atmosphere at room temperature is determined, and the loosening torque is compared with the tightening torque. By this, it can be determined how much the spark plug 1 was loosened. Here, a "retention rate" shown in FIG. 4 refers to a percentage of a value which is loosening torque divided by tightening torque, and is an indicator designating how much the axial force remains when the gasket 2 is left under high-temperature atmosphere.

In this test, the used gaskets 2 were 17 mm in outer diameter, 12 mm in inner diameter, and determined as M12 in JIS (Japanese Industrial Standards) B8031. The predetermined tightening torque was 16 Nm. In this test, four types of gaskets differing in components, four gaskets for each type were prepared, and this test for each gasket was performed under the same condition. Table 1 shows the respective result values in this test.

TABLE 1

| | TIGHTENING TORQUE (Nm) | LOOSENING TORQUE (Nm) | RETENTION RATE (%) | AVERAGE (%) |
|---|---|---|---|---|
| Cu + | 16 | 8.30 | 51.88 | 52.8 |
| $Al_2O_3$ | 16 | 8.20 | 51.25 | |
| 0.7 wt % | 16 | 8.50 | 53.13 | |
| | 16 | 8.80 | 55.00 | |
| Cu + | 16 | 4.80 | 30.00 | 26.3 |
| $Al_2O_3$ | 16 | 3.80 | 23.75 | |
| 0.3 wt % | 16 | 4.20 | 26.25 | |
| | 16 | 4.00 | 25.00 | |
| Cu | 16 | 2.30 | 14.38 | 12.0 |
| | 16 | 1.80 | 11.25 | |
| | 16 | 1.60 | 10.00 | |
| | 16 | 2.00 | 12.50 | |
| Fe | 16 | 8.20 | 51.25 | 50.8 |
| | 16 | 7.89 | 49.31 | |
| | 16 | 8.90 | 55.63 | |
| | 16 | 7.50 | 46.88 | |

As shown in FIG. 4 and Table 1, in the gasket 2 composed of only copper, an average of the retention rate was 12.0%. It was confirmed that 80% or more among the axial force loaded from the spark plug on the gasket by the tightening torque was lost because of the creep of copper under high-temperature atmosphere. Compared to this, in the gasket composed of iron which is resistant to creep, an average of the retention rate was 50.8%. It was confirmed that the axial force is remained more than the gasket composed of only copper.

On the other hand, in the gasket composed of copper alloy containing 0.7 wt % aluminum oxide, an average of the retention rate was 52.8%. It was confirmed that the gasket composed of copper alloy containing 0.7 wt % aluminum oxide was comparable in retention rate to the gasket composed of iron. In the gasket composed of copper alloy containing 0.3 wt % aluminum oxide, an average of the retention rate was 26.3%. It was confirmed that the retention rate of the gasket composed of copper alloy containing 0.3 wt % aluminum oxide was lower than that of the gasket composed of copper alloy containing 0.7 wt % aluminum oxide, however higher than that of the gasket composed of only copper.

A conceivable reason for the above result is a relation between hardness of materials and the creep. Iron is resistant to the creep, because the Vickers hardness of iron is 180 Hv. Compared to this, copper is liable to creep, because the Vickers hardness of copper is 110 Hv. Therefore, the decrease in hardness is liable to be dominantly reflected by the decrease in retention rate. The copper alloy containing 0.7 wt % aluminum oxide, according to this embodiment, is 160 Hv in Vickers hardness, and has prevented the creep better than only copper. Therefore, the axial force is likely to be held in the gasket 2 composed of the copper alloy, and the gasket 2 composed of the copper alloy can have the retention rate equivalent to or more than that of the gasket composed of iron. Therefore, this embodiment can provide the gasket 2 which keeps an axial force under high-temperature environments, prevents looseness, and has durability.

The gasket 2 composed of copper alloy containing aluminum oxide between 0.3 wt % and 0.7 wt % has a retention rate ranging between the retention rate at 0.3 wt % and the retention rate at 0.7 wt %, and the hardness increases with the increase in content of aluminum. Therefore, the gasket 2 composed of the copper alloy containing 0.3 wt % to 0.7 wt % aluminum oxide can ensure a higher retention rate than the gasket composed of copper does. If the retention rate is higher than the gasket composed of only copper, the gasket can show the effect according to the present invention, furthermore, it is more desirable that the retention rate is higher than 20%.

The gasket composed of copper alloy containing aluminum oxide more than 0.7 wt % in content is not desirable, because the after-described leak volume increases, which undermines sealing properties. In addition, there is a problem that thermal conductivity tends to decrease with the increase in content of aluminum oxide. If thermal conductivity decreases, heat retained in the gasket prevents temperature of the gasket from decreasing, which is liable to cause hardness to decrease.

Furthermore, copper alloy containing aluminum oxide more than 0.7 wt % in content has a property that hardness decreases with the increase in content of aluminum oxide. In addition to the problem that hardness decreases in accordance with the decrease in thermal conductivity, copper alloy containing aluminum oxide more than 0.7 wt % in content is liable to suffer creep, therefore, unsuitable for constituting the gasket 2.

The gasket 2 composed of copper alloy containing aluminum oxide less than 0.3 wt % in content approaches to the composition of copper, so that hardness is substantially comparable to hardness of copper. Therefore, the gasket 2 composed of copper alloy containing aluminum oxide less than 0.3 wt % in content is not desirable, because it is liable to suffer the creep.

The gasket 2 according to this embodiment is formed flat, and the cross-section in a plane containing the axis of the spark plug is rectangular.

In the flat gasket 2, the displacement amount in the axial direction of the spark plug and the variability range of the displacement amount when the tightening torque is applied are small, which can reduce adverse effect of the gasket 2 on positioning the ground electrode 13.

When the spark plug 1 which has a positioning function for positioning the spark plug 1 at a target position is used, the position of the ground electrode 13 on the combustion chamber side is positioned by tightening with the specified tightening torque determined depending on a target turn angle. The displacement amount of the gasket 2 varying causes the tightening torque needed for positioning the ground electrode 13 to vary. For this, when the spark plug 1 is tightened with the tightening torque to be fastened to the internal combustion engine 3 in fact, the position of the ground electrode 13 varies because of differences between a desired tightening torque needed for positioning the ground electrode 13 and the actual loaded tightening torque. Using the flat gasket 2 can reduce the variability of the displacement amount of the spark plug 1. This allows the ground electrode 13 of the spark plug 1 to be positioned accurately without being affected by the gasket 2, when the specified tightening torque is loaded.

It is desirable that the contact pressure loaded on the gasket 2 with the specified tightening torque is 40 $N/mm^2$ or more. This can prevent water and gas etc. from leaking from the combustion chamber of the internal combustion engine 3 outside, and allows the gasket 2 to show its good sealing properties.

Figure 5:
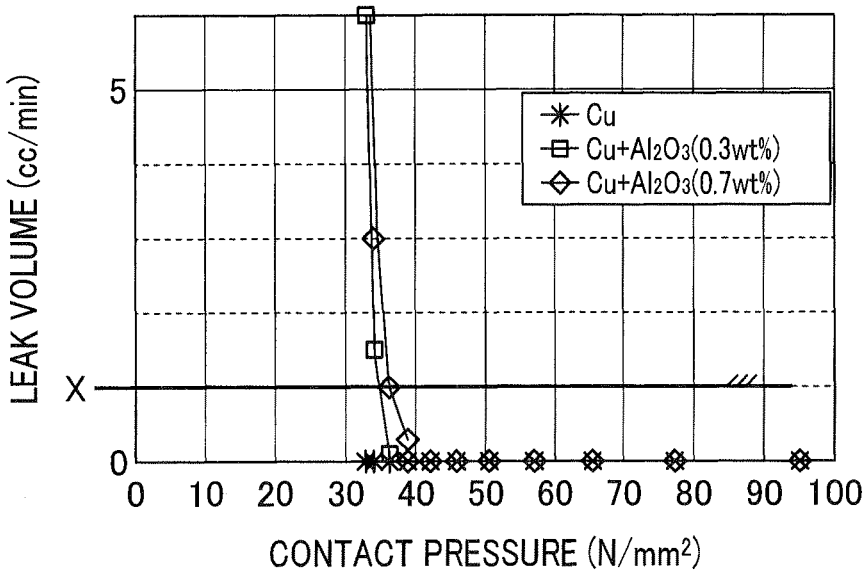
FIG. 5 is a chart illustrating relations between contact pressure and leak volume in the first embodiment.

Next, a sealing test was performed for examining a relation between the leak volume from the internal combustion engine 3 outside and the contact pressure loaded on the gasket 2. In the sealing test, the gasket 2 composed of only copper and the gasket 2 composed of the copper alloy according to this embodiment, which is formed by adding aluminum oxide to copper, were used, and their leak volume were compared. FIG. 5 shows the results of the sealing test.

In the sealing test, three types of gaskets 2 differing in component were prepared, one of them was composed of only copper, another of them was composed of copper alloy containing 0.3 wt % aluminum oxide, and the other was composed of copper alloy containing 0.7 wt %. The gaskets 2 were 17 mm in outer diameter, and 12 mm in inner diameter. Then, leak volume from the internal combustion engine 3 outside under different contact pressure was measured. FIG. 5 shows contact pressure on the abscissa and leak volume on the ordinate.

As shown in FIG. 5, the gasket 2 composed of only copper was 0 (zero) in leak volume when the contact pressure was 30 $N/mm^2$ or more. It was confirmed that the gasket 2 composed of copper shows good sealing properties. Both gaskets 2 composed of copper alloy which was made by adding aluminum oxide to copper, i.e. the two types of gaskets 2 composed of copper alloy containing 0.3 wt % and 0.7 wt % aluminum, were 0 in leak volume as same as the gasket composed of only copper, when the contact pressure was 40 $N/mm^2$ or more.

In the gasket composed of copper alloy containing aluminum oxide, the leak occurred at the contact pressure range smaller than 40 $N/mm^2$. The more aluminum oxide content in the copper alloy composing the gasket is, the larger the leak amount of the gasket tends to be than that of the gasket composed of the copper alloy containing less aluminum oxide at same contact pressure.

The line X in FIG. 5 shows the point at which the leak volume is 1 cc/min, the leak volume range at 1 cc/min or less is determined as no leak in JIS. The gasket 2 composed of the copper alloy according to this embodiment showed the value of the line X or less in leak volume at 40 N/mm$^2$ or more in contact pressure, which confirmed that it had adequate sealing properties.

Therefore, the gasket 2 composed of the copper alloy according to this embodiment can show good sealing properties which are similar level to the gasket 2 composed of only copper, at 40 N/mm$^2$ or more in contact pressure.

Second Embodiment

Figure 6:
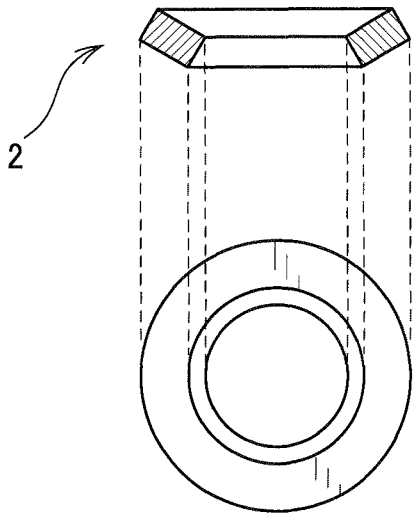
FIG. 6 is a cross-sectional view and a plan view of a gasket according to a second embodiment.

A gasket 2 according to a second embodiment, as shown in FIG. 6, is annular, and has a plug contact surface 21 facing the plug seating surface 113 and an engine contact surface 22 facing the attachment seating surface 33. The plug contact surface 21 and the engine contact surface 22 are inclined such that the inner periphery side of the gasket 2 projects toward the axial direction of the gasket 2. As same as the first embodiment, the gasket 2 is composed of copper alloy containing 0.3 wt % to 0.7 wt % aluminum oxide. This can be formed by pressing or other methods such as casting.

When the spark plug 1 is tightened with the gasket 2 which has such a cross-sectional surface being disposed between the spark plug 1 and the internal combustion engine 3, the gasket 2 is also deformed to have the flat plate-like structure, as shown in FIG. 2. This allows the gasket 2 to show the same effect as the effect described in the first embodiment.

Furthermore, the cross-sectional shape according to the second embodiment has an advantage described below. In the gasket 2 according to the second embodiment, the contact pressure is concentrically-loaded on the inner periphery side of the engine contact surface 22 and the outer periphery side of the plug contact surface 21. For this, smaller tightening torque than that needed in the first embodiment allows the contact pressure on the concentrically-loaded portions to become 40 N/mm$^2$ or more, which makes the workability for tightening easier. As shown by this embodiment, the gasket in which a portion to be sandwiched between the combustion chamber 3 and the spark plug 1 is composed of single layer of metal sheet is suitable for use needed accurate positioning. In place of the single layer, the gasket composed of laminate without substantially any gap, shrinkable when the spark plug is fastened, between layers, can be used.

Third Embodiment

Figure 7:
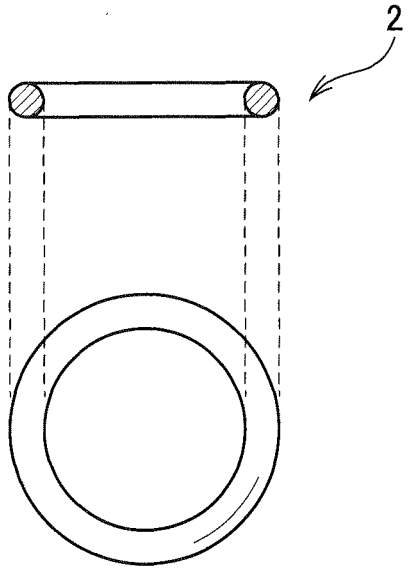
FIG. 7 is a cross-sectional view and a plan view of a gasket according to a third embodiment.

In a ring gasket 2 according to a third embodiment, as shown in FIG. 7, a cross-section in a plane including the axis of the spark plug 1 is circular. As same as the first embodiment, the gasket 2 is composed of copper alloy containing 0.3 wt % to 0.7 wt % aluminum oxide.

Figure 8:
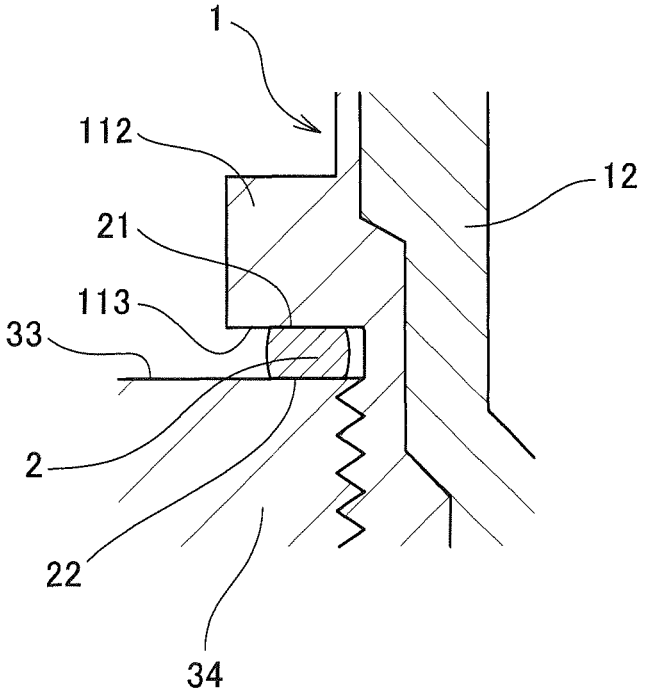
FIG. 8 is a cross-sectional view illustrating an enlarged main portion of the gasket according to the third embodiment with the gasket located between the spark plug and the internal combustion engine.

When the spark plug 1 is tightened with the gasket 2 which has such a cross-sectional surface being disposed between the spark plug 1 and the internal combustion engine 3, the axial force loaded on the gasket 2 also makes the gasket 2 to deform as shown in FIG. 8. Then, the gasket 2 has the flat plate-like structure such that the plug contact surface 21 and the engine contact surface 22 are formed in the gasket 2. This allows the gasket 2 to show the same effect as the effect described in the first embodiment.

Furthermore, in the cross-sectional shape according to the third embodiment, the contact between the plug contact surface 21 and the plug seating surface 113 and the contact between the engine contact surface 22 and the attachment seating surface 33 are close to point contact. Therefore, the contact pressure is concentrically-loaded on the contact points, so that smaller tightening torque than that needed in the first embodiment allows the contact pressure on the concentrically-loaded portions to become 40 N/mm$^2$ or more.

Though the invention has been described with respect to the specific preferred embodiments, many variations and modifications will become apparent to those skilled in the art upon reading the present application. It is therefore the intention that the claims be interpreted as broadly as possible in view of the prior art to include all such variations and modifications.

What is claimed is:

1. A gasket for attaching a spark plug to an internal combustion engine, the spark plug having a screw portion and a plug large diameter portion, the screw portion engaging with a wall member forming an combustion chamber of an internal combustion engine, the plug large diameter portion being disposed across from the combustion chamber with the screw portion disposed between the plug large diameter portion and the combustion chamber, the plug large diameter portion having a larger diameter than the screw portion, the gasket comprising:

an annular portion surrounding the spark plug and having a flat plate-like structure between the wall member and the spark plug when the spark plug is fastened to the wall member; and contact surfaces formed on both axial ends of the annular portion and configured to be sandwiched between the spark plug and the internal combustion engine in surface contact with a plug seating surface and an attachment seating surface, the plug seating surface being formed on the plug large diameter portion of the spark plug, the attachment seating surface being formed on the wall member of the internal combustion engine, wherein at least the contact surfaces are made of copper alloy containing aluminum oxide, and the aluminum oxide content of the copper alloy is 0.7 wt %, and a Vickers hardness of the copper alloy is 160 Hv or more.

2. The gasket according to claim 1, wherein pressure per unit area, which is loaded on each contact surface, is 40 N/mm$^2$ or more.

3. The gasket according to claim 1, wherein the gasket is annular in a planar view, and before the spark plug has been fastened to the wall member, the contact surfaces are inclined such that the inner periphery side of the gasket projects toward the axial direction of the gasket.

4. The gasket according to claim 1, wherein before the spark plug has been fastened to the wall member, the annular portion has a circular cross-section in a plane including the axis thereof.

5. An ignition system, comprising:

a spark plug having an axis, a ground electrode projecting to a combustion chamber of an internal combustion engine, a screw portion being formed across from the combustion chamber in the axial direction with the ground electrode disposed between the screw portion and the combustion chamber, a plug large diameter portion being formed across from the combustion chamber with the screw portion disposed between the plug large diameter portion and the combustion chamber, the plug large diameter portion having a larger diameter than that of the screw portion;

a wall member forming a combustion chamber of an internal combustion engine; and a gasket sandwiched between the wall member and the spark plug with axial load of the spark plug, the gasket having an annular portion and contact surfaces, the annular portion surrounding the outer periphery of the spark plug and having a flat plate-like structure between the wall member and the spark plug when the spark plug is fastened to the wall member, the contact surfaces being formed on both axial ends of the annular portion and sandwiched between the spark plug and the wall member in surface contact with a plug seating surface and an attachment seating surface, the plug seating surface being formed on the plug large diameter portion of the spark plug, the attachment seating surface being formed on the wall member of the internal combustion engine, wherein:

at least the contact surfaces are composed of copper alloy containing aluminum oxide;

the aluminum oxide content of the copper alloy is 0.7 wt %; and a Vickers hardness of the copper alloy is 160 Hv or more.

6. The ignition system according to claim 5, wherein, pressure per unit area, which is loaded on each contact surface, is 40 $N/mm^2$ or more.

7. The ignition system according to claim 5, wherein the gasket is annular in a planar view, and before the spark plug has been fastened to the wall member the contact surfaces are inclined such that the inner periphery side of the gasket projects toward the axial direction of the gasket.

8. The ignition system according to claim 5, wherein before the spark plug has been fastened to the wall member, the annular portion has a circular cross-section in a plane including the axis of the spark plug.

* * * * *